US006125665A

United States Patent [19]

Lonati et al.

[11] Patent Number: 6,125,665

[45] Date of Patent: Oct. 3, 2000

[54] METHOD FOR PRODUCING STOCKINGS WITH FORM-FITTING SHAPE, AND STOCKING OBTAINED WITH THE METHOD

[75] Inventors: Francesco Lonati; Ettore Lonati; Tiberio Lonati; Fausto Lonati, all of Brescia, Italy

[73] Assignee: Lonati S.p.A., Monza, Italy

[21] Appl. No.: 09/225,678

[22] Filed: Jan. 6, 1999

[30] Foreign Application Priority Data

Jan. 14, 1998 [IT] Italy ..... MI98A0048

[51] Int. Cl.[7] ..... D04B 9/46

[52] U.S. Cl. ..... 66/183; 66/189; 2/239

[58] Field of Search ..... 66/23, 27, 54, 66/71, 77, 178 R, 180, 181, 183, 184, 189; 2/239, 240, 241, 242

[56] References Cited

U.S. PATENT DOCUMENTS

| | | | |
|---|---|---|---|
| 2,190,148 | 2/1940 | Clauss | 66/183 |
| 2,375,253 | 5/1945 | Schubert | 66/183 |
| 2,591,566 | 4/1952 | Livingston . | |
| 2,703,970 | 3/1955 | Cole et al. | 66/184 |
| 3,216,223 | 11/1965 | Margulies . | |
| 3,386,270 | 6/1968 | Simmons | 66/183 |
| 4,373,361 | 2/1983 | Thorneburg | 66/183 |

FOREIGN PATENT DOCUMENTS

| | | |
|---|---|---|
| 0112505 | 7/1984 | European Pat. Off. . |
| 1555602 | 1/1969 | France . |
| 151297 | 3/1919 | United Kingdom . |

*Primary Examiner*—Danny Worrell

*Attorney, Agent, or Firm*—Guido Modiano; Albert Josif; Daniel O'Byrne

[57] ABSTRACT

A method for producing stockings, particularly of the pop-sock type or the like, with a form-fitting shape, and a stocking obtained with the method comprising: a first step, during which the stocking portion that corresponds to the leg region located above the calf is formed; a second step, during which the stocking portion corresponding to the intermediate region of the leg is formed; and a third step, during which the stocking portion that corresponds to the leg region located below the calf is formed. During the second step the length of the loops of knitting located in the rear region of the stocking is increased with respect to the length of the loops of knitting located in the front region, in order to obtain, on the rear region of the stocking, an extra portion with respect to the front region; the extra portion has to contain the calf.

6 Claims, 3 Drawing Sheets

METHOD FOR PRODUCING STOCKINGS WITH FORM-FITTING SHAPE, AND STOCKING OBTAINED WITH THE METHOD

BACKGROUND OF THE INVENTION

The present invention relates to a method for producing stockings, particularly of the pop-sock type or the like, with form-fitting shape, and to a stocking obtained with the method.

Two kinds of stocking of the pop-sock type, i.e., stockings whose top reaches above the calf, are currently commercially available: stockings which have a tapering portion in the lower calf region, and stockings without a tapering portion.

Stockings having a tapering portion in the lower calf region are produced usually starting from their elastic top, which constitutes the upper end of the stocking and can be produced with derby or links knitting, and by forming the intermediate region of the leg with a loop length which meets fit requirements in the region occupied by the calf and then continuing with gradually shorter loops of knitting until a compression suitable for fitting the ankle region is achieved. In practice, in this type of stocking the intermediate region of the leg has a substantially conical shape, since the gradual shortening of the loops is performed row by row and the loops of a same row have the same length.

In stockings without a tapering portion, the leg region is formed with loops which have a substantially constant length from the top to the ankle region. Consequently, stockings without a tapering portion have a worse fit, since the shape of the stocking in the leg region substantially has a constant diameter and is considerably different from the actual configuration of the user's leg. This different configuration is partially compensated by the elasticity of the yarns used, but the result, in terms of fit, is scarcely satisfactory.

Although stockings with a tapering portion have a better fit, shortcomings are in any case suffered because the shape of the stocking in the leg region is still different from the actual shape of the user's leg.

SUMMARY OF THE INVENTION

The aim of the present invention is to solve the above problem by providing a method which allows to produce stockings, particularly of the pop-sock type or the like, with a form-fitting shape which achieves a distinctly better fit than currently commercially available stockings of the pop-sock type or the like.

Within the scope of this aim, an object of the invention is to provide a method which allows to produce a stocking with a particularly comfortable form-fitting configuration.

Another object of the invention is to provide a method which can be performed on a wide range of currently commercially available stocking-making machines.

This aim, these objects and others which will become apparent hereinafter are achieved by a method for producing stockings, particularly of the pop-sock type or the like, with a form-fitting shape, comprising: a first step, during which the stocking portion that corresponds to the leg region located above the calf is formed; a second step, during which the stocking portion that corresponds to the intermediate region of the leg is formed; and a third step, during which the stocking portion that corresponds to the leg region located below the calf is formed; characterized in that during said second step the length of the loops of knitting located in the rear region of the stocking is increased with respect to the length of the loops of knitting located in the front region, in order to obtain, on the rear side of the stocking, an extra portion with respect to the front part, said extra portion being meant to contain the calf.

The stocking obtained with the method according to the invention is characterized in that in the intermediate region of the leg its rear region is constituted by loops of knitting which are longer than the loops of the front region.

BRIEF DESCRIPTION OF THE DRAWINGS

Further characteristics and advantages of the present invention will become apparent from the following detailed description of a preferred but not exclusive embodiment of the method according to the invention, illustrated only by way of non-limitative example in the accompanying drawings, wherein.

DESCRIPTION OF THE PREFERRED EMBODIMENTS

With reference to the above Figures, the method according to the invention comprises a first step 1, during which the stocking portion A, which corresponds to the region of the leg located above the calf, is formed; a second step 2, during which the stocking portion that corresponds to the intermediate region of the leg is formed; and a third step 3, during which the stocking portion F, which corresponds to the region of the leg located below the calf, is formed.

The first step of the method, during which the stocking portion A is formed, can be performed in a per se known manner, for example by knitting a top with elastic yarn, for example with derby or links knitting.

According to the invention, during the second step the length of the loops of knitting located in the rear region 10 of the stocking is increased with respect to the length of the loops of knitting located in the front region 11, so as to obtain, on the rear side of the stocking, an extra portion with respect to front part; said extra portion is meant to contain the calf of the user.

Figures 1, 2:
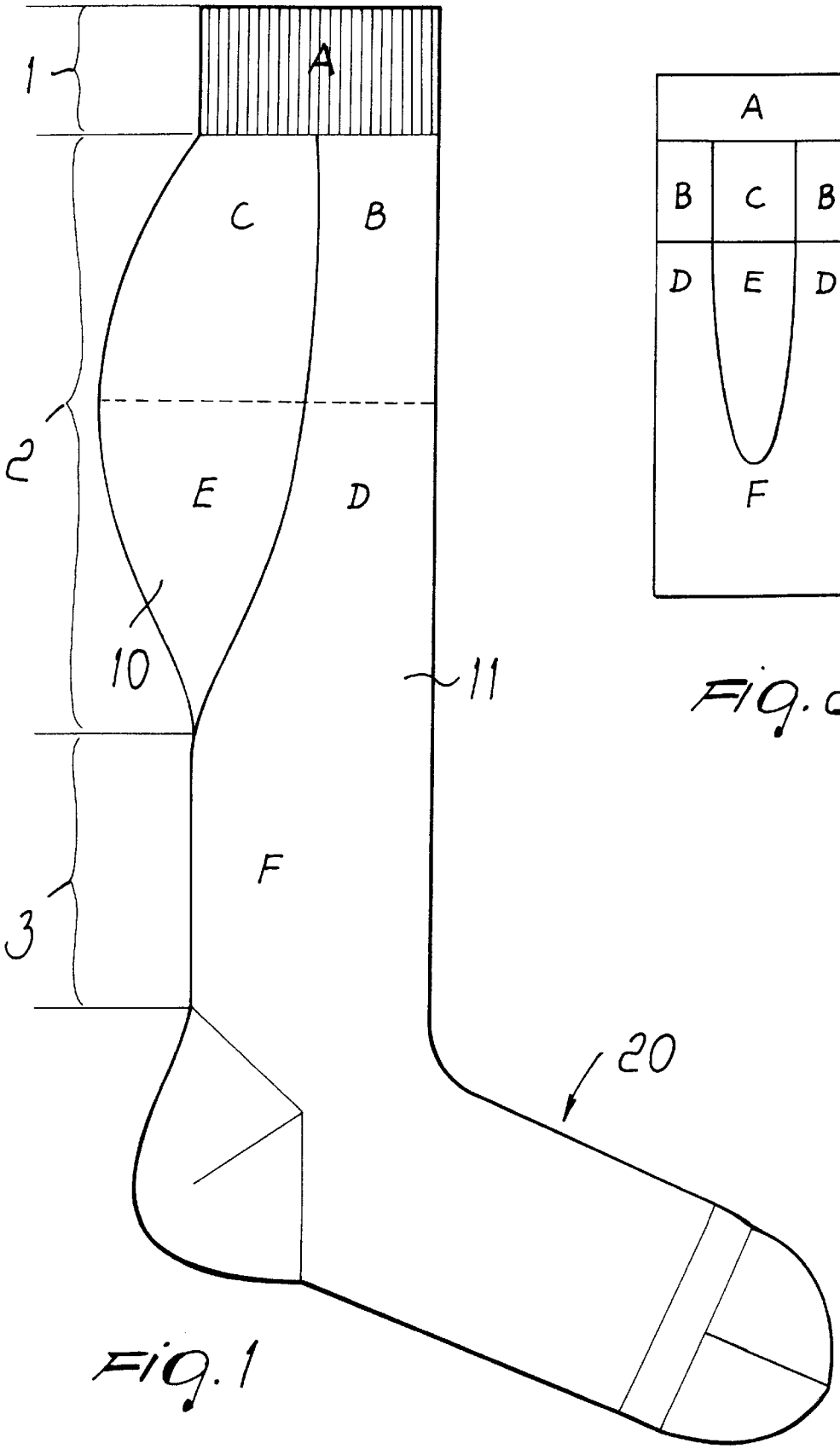
FIG. 1 is a schematic side elevation view of a stocking obtained with the method according to the invention.
FIG. 2 is a schematic rear elevation view of the stocking portion related to the leg region.
Figure 3:
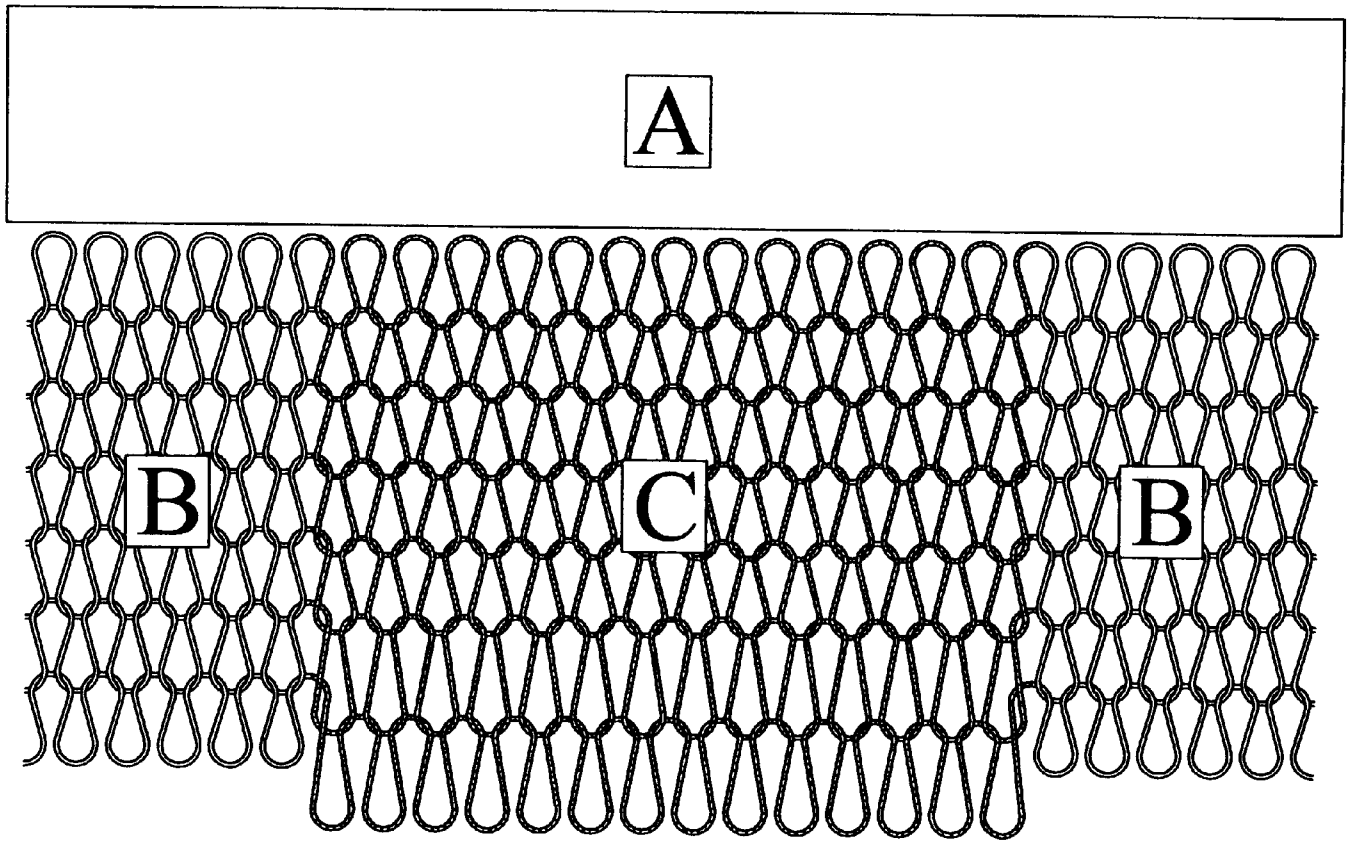
FIG. 3 is an enlarged-scale view of a detail of FIG. 2.

More particularly, during the second step, initially the length of the loops of knitting located in the rear region 10 is gradually increased row by row, forming the portion C, and is then decreased row by row, forming the portion E, as shown in particular in FIG. 3. The length of the loops that compose the portion C is increased gradually, row by row, so as to obtain in the rear region 10 a gradual widening of the stocking from the top downward starting from the portion A formed during the first step of the method, while the loops of the same rows of knitting that compose the front portion B have a substantially constant length.

During the formation of the portion E, the length of the loops is gradually decreased row by row so as to gradually return it to the same length as the loops of the front portion D, and so as to then continue to form the region F in the third step of the method with said loop length or with a shorter loop length according to requirements.

Figure 4:
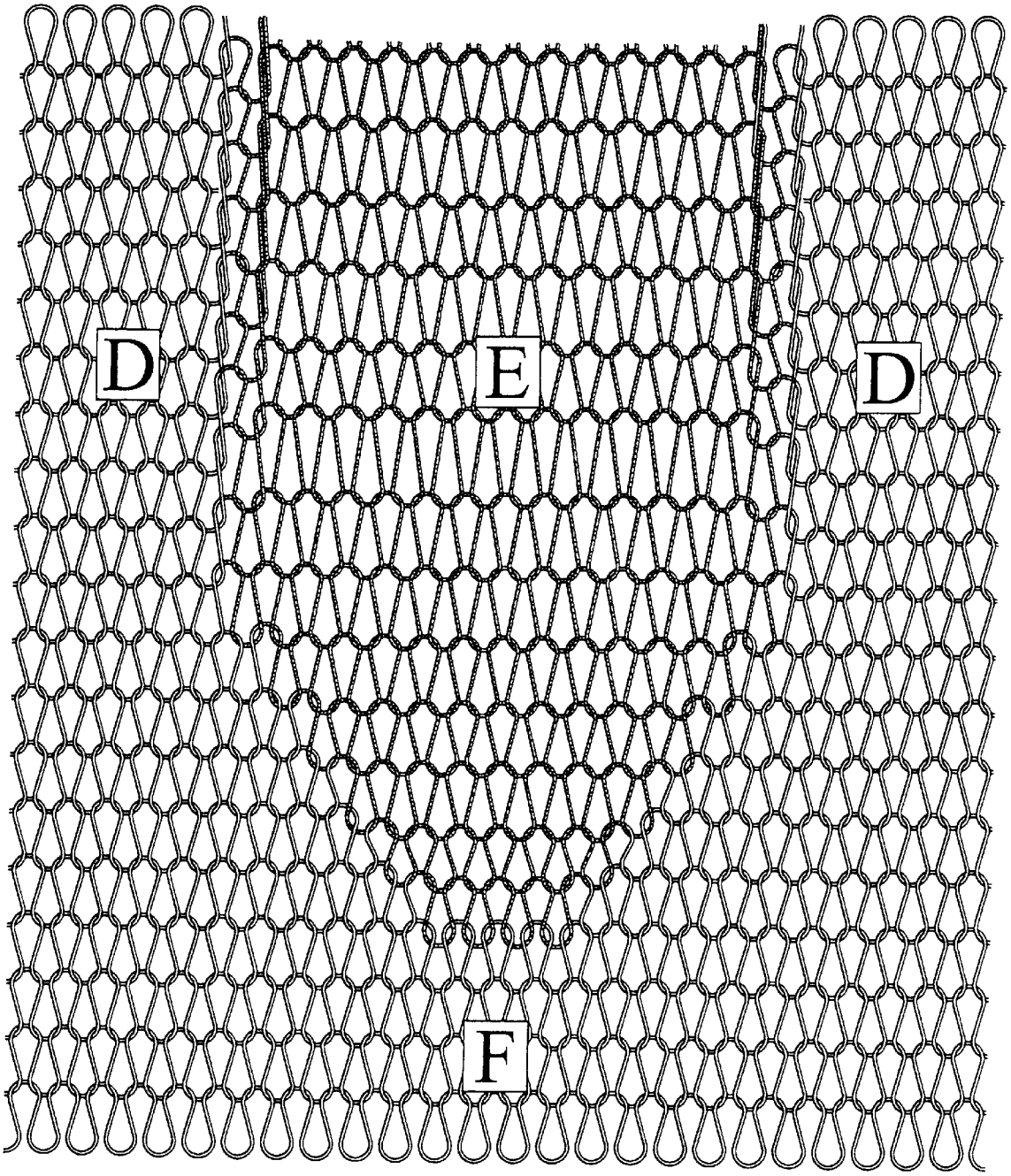
FIG. 4 is an enlarged-scale view of another detail of FIG. 2.

In the last few rows of knitting formed during the second step, the number of longer loops of the rear region 10, as shown in particular in FIG. 4, is reduced gradually so as to perform a lateral tapering of the rear portion E in order to follow the anatomical configuration of the calf.

The third step of the method according to the invention can be performed in a conventional manner. The stocking is then completed by forming the foot region, which is generally designated by the reference numeral 20.

The variation in the length of the loops to form the portions C and E with respect to the length of the loops of the portions B and D can be performed in a per se known manner by using the devices for varying the length of the loops of knitting with which currently commercially available stocking-making machines are equipped and by selecting the set of needles that must form these longer loops, using, in this case also, conventional needle selection devices, which are not described further for the sake of simplicity.

In practice, in the second step the needles of the machine that must form the portions C and E are actuated, by acting on the lowering cams of the machine which determine the length of the loops of knitting, so as to form longer loops of knitting than the needles that must form the portions B and D.

It should be observed that the formation of the stocking, instead of beginning from the top A, might begin, in a per se known manner, from the tip of the foot 20 of the stocking. In this case, during the formation of the stocking portion that corresponds to the leg region, there would be: a first step, during which the stocking portion F, which corresponds to the leg region located below the calf, is formed; a second step, during which the stocking portion that corresponds to the intermediate region of the leg is formed; and a third step, during which the stocking portion A, which corresponds to the leg region located above the calf, is formed. In this case also, during the second step the length of the loops of knitting located in the rear region 10 of the stocking is increased with respect to the length of the loops of knitting located in the front region 11, so as to obtain, on the rear side of the stocking, an extra portion with respect to the front part, said portion being adapted to contain the calf.

In this case, during the second step the length of the loops of knitting located in the rear region is initially increased gradually row by row, forming the portion E, and is then decreased row by row, forming the portion C, while the length of the loops in the front part, during the forming of the portions D and B, remains substantially constant.

During the formation of the first rows of knitting formed in the second step, the number of longer loops of knitting of the rear region is gradually increased in order to obtain the shape of the portion E as in the formation of the stocking starting from the top.

In the stocking obtained with the method according to the invention, the rear region of the intermediate portion of the leg is constituted by loops of knitting which are longer than the loops of the front region and which accordingly form extra fabric with a configuration which perfectly matches the anatomical shape of the calf.

In practice it has been observed that the method according to the invention fully achieves the intended aim, since it allows to obtain stockings which have a formfitting shape ensuring excellent fit and being particularly comfortable for the user.

The method thus conceived is susceptible of numerous modifications and variations, all of which are within the scope of the inventive concept; all the details may further be replaced with other technically equivalent elements.

In practice, the materials employed, as well as the dimensions, may be any according to requirements and to the state of the art.

The disclosures in Italian Patent Application No. MI98A000048 from which this application claims priority are incorporated herein by reference.

What is claimed is:

1. A method for producing stockings with a form-fitting shape, with loops of knitting forming rows of loops, each stocking having an upper portion, an intermediate calf portion with a rear and a front region thereof, a lower portion, and a foot region, the method comprising: a first step, during which the stocking portion that corresponds to said upper portion is formed; a second stop, during which the stocking portion that corresponds to said intermediate calf portion is formed; and a third step, during which the stocking portion that corresponds to said lower portion is formed, and wherein said second step comprises increasing length extending in a direction perpendicular to said rows of the loops of knitting of a thread located in said rear region of the intermediate portion with respect to a length extending in the direction perpendicular to said rows of the loops of knitting of said thread located in said front region, for obtaining, at said rear region, an extra portion with respect to said front region, said extra portion being adapted to contain a user calf, and wherein during said second step the length of the loops of knitting located in the rear region is initially increased gradually row by row for a number of loops and is subsequently decreased row by row.

2. The method of claim 1, wherein the number of longer loops of knitting of said rear region is gradually decreased at forming last rows of knitting knitted in said second step.

3. A method for producing stockings with a form-fitting shape, with loops of knitting forming rows of loops, each stocking having an upper portion, an intermediate calf portion with a rear and a front region thereof, a lower portion, and a foot region, the method comprising: a first step, during which the stocking portion that corresponds to said lower portion is formed; a second step, during which the stocking portion that corresponds to said intermediate calf portion is formed; and a third step, during which the stocking portion that corresponds to said upper portion is formed, and wherein said second step comprises increasing leg extending in a direction perpendicular to said rows of the loops of knitting of a thread located in said rear region of the intermediate portion with respect to a length extending in the direction perpendicular to said rows of the loops of knitting of said thread located in said front region, for obtaining, at said rear region, an extra portion with respect to said front region, said extra portion being adapted to contain a user calf, and wherein during said second stop the length of the loops of knitting located in said rear re ion is initially increased gradually row by row for a number of loops and is subsequently decreased row by row.

4. The method of claim 3, wherein the number of longer loops of knitting of said rear region is gradually increased at forming first rows of knitting formed during said second step.

5. A stocking with a form-fitting shape formed by subsequent rows of loops of knitting and having an upper portion, an intermediate calf portion with a rear and a front region thereof, a lower portion, and a foot region, wherein the rear region of said intermediate calf region is constituted by loops of knitting of a read which are longer in a direction perpendicular to said rows, than the loops of knitting of said thread of the front region, and wherein in said rear region the loops of knitting increase in length row by row starting from the upper portion of the stocking toward the lower portion of the stocking for a number of loops, and subsequently decrease in length.

6. The stocking of claim 5, wherein the number of longer loops of knitting of said rear region decreases gradually at rows of knitting located proximate to a lower end of said rear region.

* * * * *